US007215311B2

(12) United States Patent
Kim

(10) Patent No.: US 7,215,311 B2
(45) Date of Patent: May 8, 2007

(54) LCD AND DRIVING METHOD THEREOF

(75) Inventor: Young-Ki Kim, Kyungki-do (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 78 days.

(21) Appl. No.: 10/046,772

(22) Filed: Jan. 17, 2002

(65) Prior Publication Data

US 2002/0118154 A1 Aug. 29, 2002

(30) Foreign Application Priority Data

Feb. 26, 2001 (KR) ..... 2001-9672

(51) Int. Cl.
*G09G 3/36* (2006.01)

(52) U.S. Cl. ..... 345/98; 345/87; 345/89; 345/95; 345/100; 345/204

(58) Field of Classification Search ..... 345/87–100, 345/210–214, 204–206; 349/33, 34, 37
See application file for complete search history.

(56) References Cited

U.S. PATENT DOCUMENTS 5,682,175 A * 10/1997 Kitamura ..... 345/98
5,886,679 A * 3/1999 Matsuda et al. ..... 345/96
5,892,493 A 4/1999 Enami et al.
5,907,314 A * 5/1999 Negishi et al. ..... 345/103
5,943,034 A 8/1999 Adachi
6,064,363 A 5/2000 Kwon
6,124,840 A * 9/2000 Kwon ..... 345/100
6,271,816 B1 * 8/2001 Jeong et al. ..... 345/87
6,304,254 B1 * 10/2001 Johnson et al. ..... 345/204
6,421,039 B1 * 7/2002 Moon et al. ..... 345/100
6,573,881 B1 * 6/2003 Kwon ..... 345/92
6,670,953 B1 * 12/2003 Ozawa ..... 345/211

FOREIGN PATENT DOCUMENTS

EP 0315365 * 10/1988
GB 2351177 A 12/2000
JP 03-235989 10/1991
JP 11-085115 3/1999

OTHER PUBLICATIONS

English Abstract for Publication No. 03-235989.
English Abstract for Publication No. 11-085115.

* cited by examiner

*Primary Examiner*—Richard Hjerpe
*Assistant Examiner*—Jennifer T. Nguyen
(74) *Attorney, Agent, or Firm*—F. Chau & Associates, LLC

(57) ABSTRACT

There are provided an LCD and a driving method thereof for charging each data line of the LCD with sufficient data voltage. The present invention has a switching device installed between every adjacent data line, and the switching device connects the data line before a gate-on voltage is applied to the gate line thereby pre-charging the data line by charge sharing effect between the connected adjacent data lines and significantly reducing the change of the data line voltage by parasitic capacitance.

17 Claims, 5 Drawing Sheets

LCD AND DRIVING METHOD THEREOF

BACKGROUND OF THE INVENTION (a) Field of the Invention

The present invention relates to a liquid crystal display and a driving method thereof, and more specifically, to a thin film transistor liquid crystal display and a driving method thereof.

(b) Description of the Related Art

A thin film transistor liquid crystal display (TFT-LCD) is a display that shows desired images by forming an electric field on a layer of liquid crystals injected between two substrates, and controlling the amount of light transmitted through the substrates by changing the intensity of the electric field. The TFT-LCD is popular as a display to replace the widely used cathode ray tube (CRT) because of its power consumption, thinness, and high resolution, etc.

FIG. 1 is a representation of a TFT-LCD configuration with a circuit diagram. As shown in FIG. 1, the TFT-LCD comprises a liquid crystal panel 10, a gate driver 20, and a data driver 30.

The liquid crystal panel 10 comprises a plurality of gate lines (G1, G2, . . . , Gn) and a plurality of insulated data lines (D1, D2, . . . , Dm) crossing the gate lines, and there are a plurality of TFTs 12, each TFT area (pixel) surrounded by a gate line and a data line. A gate electrode, a source electrode, and a drain electrode of the TFT are connected to a gate line, a data line, and a pixel electrode (not shown) respectively.

The gate driver 20 applies a gate voltage to the gate line to turn the TFT on/off. The gate-on voltage is sequentially applied to the gate lines of the liquid crystal panel, and accordingly, the TFTs connected to the gate lines turn on as the gate-on voltage is applied to. The data driver 30 applies a data voltage for image signals to each data line.

The TFT-LCD is operated by applying the gate-on voltage to the gate electrode connected to the desired gate line so as to switch on the TFT, and by applying the data voltage for an image signal to the source electrode through the data line so that the data voltage reaches the drain electrode. The data voltage is transmitted to the pixel electrode, and an electric field is formed by a potential difference between the pixel electrode and the common electrode. The intensity of the electric field is controlled by the amount of data voltage, and the amount of light transmitted through the substrate is controlled by the intensity of the electric field.

But as the TFT-LCD becomes larger, parasitic capacitance of each data line increases. Then, the data voltage applied to the data lines is not enough to charge the data lines, as shown in FIG. 2.

In FIG. 2, (a) and (b) show the wave forms of data voltage (Vd) applied to odd data lines and even data lines, and of voltage (Ve) charged to the data lines. As shown in FIG. 2 (a) and (b), the data voltage (Vd) applied from the data driver 30 is significantly changed by the parasitic capacitance element from the voltage (Ve) actually charged to the data lines. That is, it takes a significant amount of time (tr) to charge the data lines to a predetermined voltage, and therefore, each pixel cannot be charged with enough data voltage.

SUMMARY OF THE INVENTION

The present invention is directed to provide an LCD and a driving method thereof in order to solve the above problems.

One object of the present invention is to provide an LCD for charging each data line of the LCD to sufficient voltage level, and a driving method thereof.

In one aspect of the present invention, a liquid crystal display comprises: a liquid crystal panel comprising a plurality of gate lines, a plurality of insulated data lines crossing the gate lines, and a plurality of first thin film transistors each having a gate electrode connected to a gate line and a source electrode connected to a data line; a gate driver for sequentially supplying a gate-on voltage to the gate lines for turning on the thin film transistors; a data driver for applying a data voltage to the data lines; a data line sharing switch having a plurality of switching devices for switching on the adjacent data lines and located on adjacent data lines; and a sharing signal generator for outputting a sharing control signal for turning on the switching devices.

The data line sharing switch may be formed on the liquid crystal panel. Preferably, the data line sharing switch can be placed on an end of the liquid crystal panel in a location opposite to the data driver.

In another aspect of the present invention, a method of driving a liquid crystal display comprising a plurality of gate lines, a plurality of insulated data lines crossing the gate lines, and a plurality of thin film transistors, each having a gate electrode connected to a gate line and a source electrode connected to a data line, the driving method comprises the steps of sequentially supplying a gate-on voltage for turning on the thin film transistor to the gate lines, connecting the adjacent data lines and charging the data lines with a predetermined voltage, and applying the data voltage to the data lines.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION OF THE PREFERRED EMBODIMENTS

In the following detailed description, only the preferred embodiments of the invention have been shown and described, simply by way of illustrating the best modes contemplated by the inventor(s) of carrying out the invention. As will be realized, the invention can be modified in various obvious respects, all without departing from the invention. Accordingly, the drawings and description are to be regarded as illustrative in nature, and not restrictive.

Figure 1:
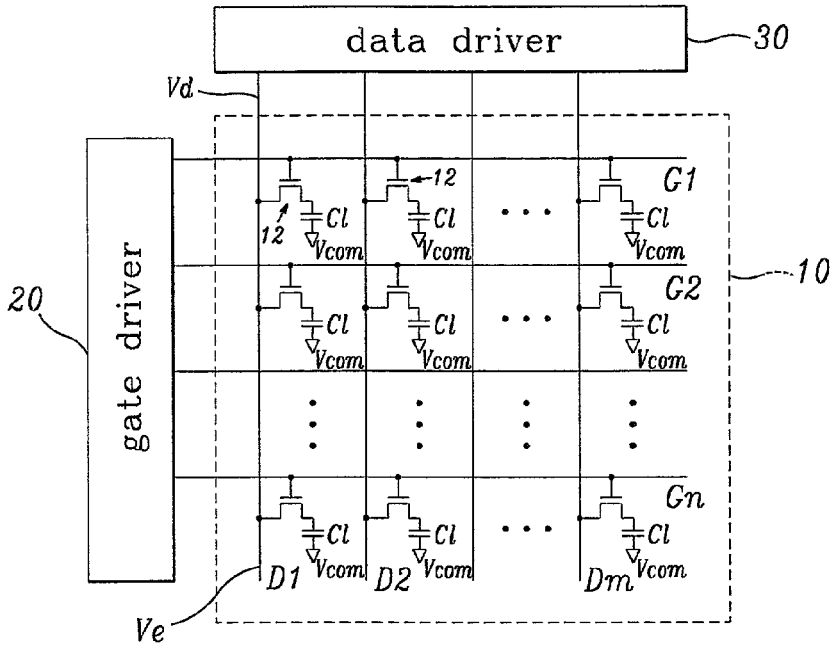
FIG.1 (PRIOR ART)
FIG. 1 is a representation showing a configuration of a TFT-LCD.
Figure 2:
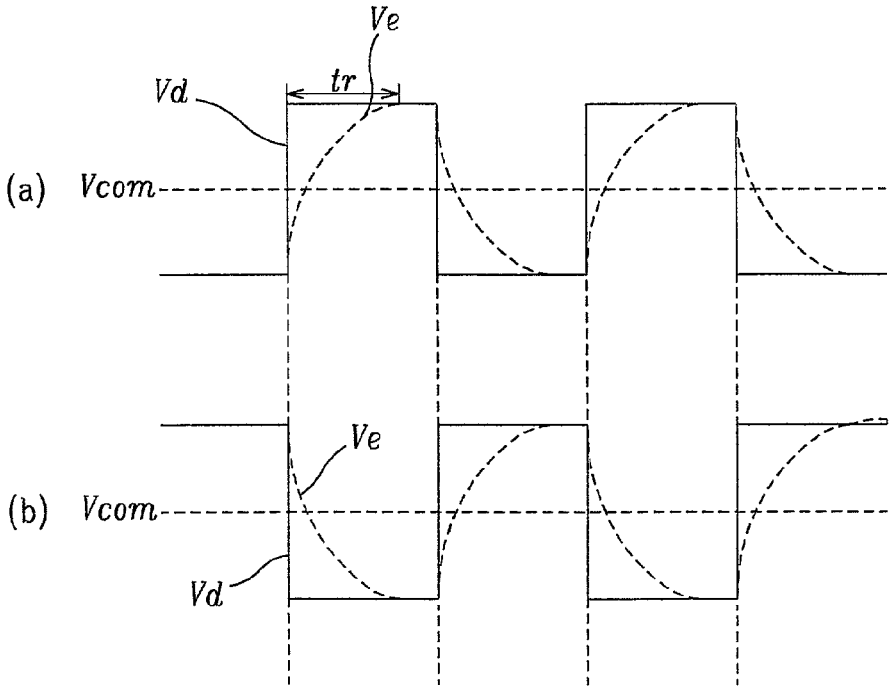
FIG.2 (PRIOR ART)
FIG. 2 shows waveforms of voltages applied to a conventional data line.
Figure 3:
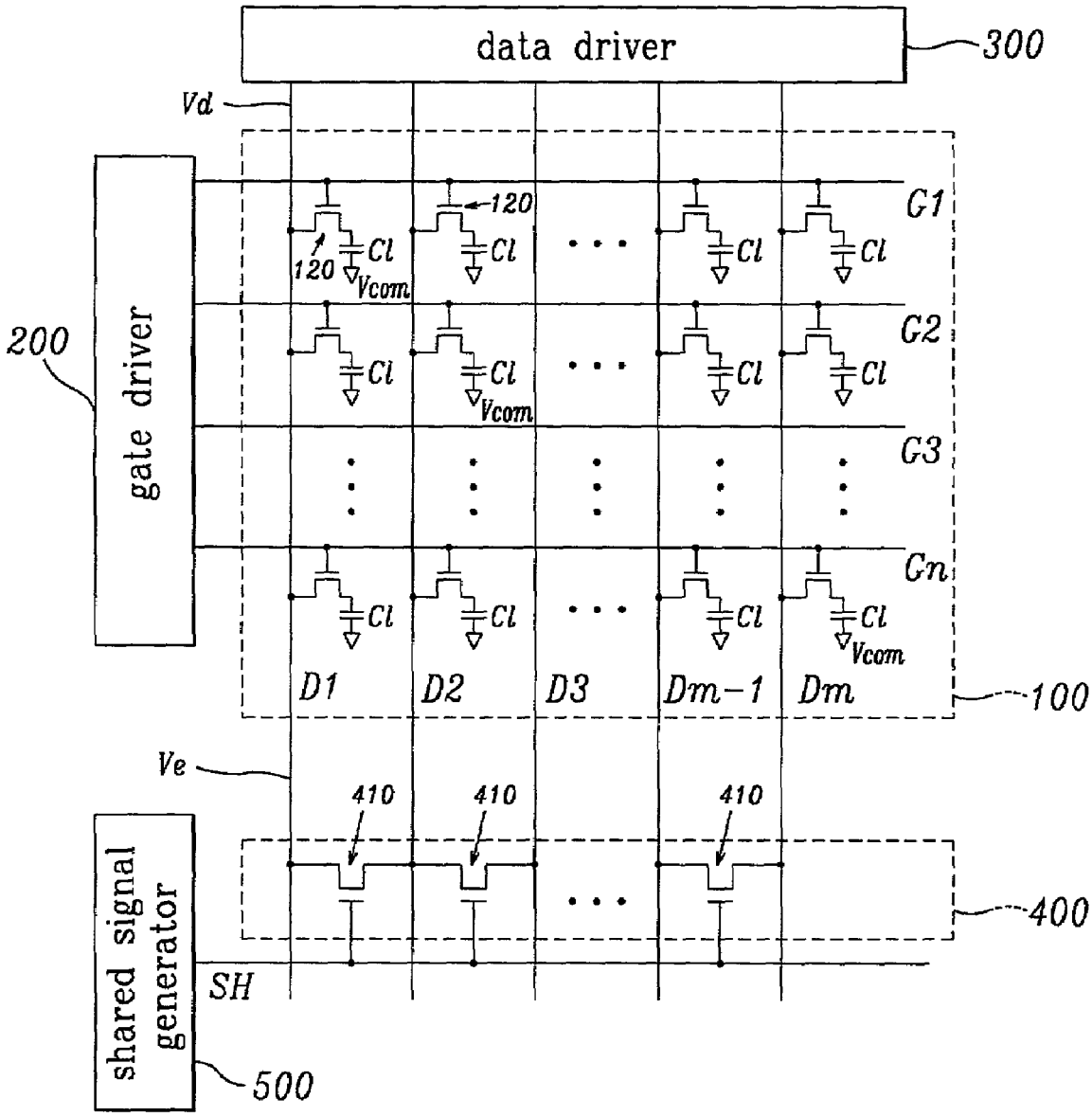
FIG. 3 is a representation showing a configuration of an LCD according to a first embodiment of the present invention.

FIG. 3 shows a configuration of an LCD according to a first embodiment of the present invention As shown in FIG. 3, the LCD according to the first embodiment of the present invention comprises a liquid crystal panel 100, a gate driver 200, a data driver 300, a data line sharing switch 400 and a sharing signal generator 500.

The liquid crystal panel 100 comprises a plurality of gate lines (G1, G2, . . . , Gn) and a plurality of data lines (D1, D2, . . . , Dm). There are a plurality of TFTs 120, a TFT o being placed in each area (pixel) surrounded by the gate line and the data line. A gate electrode, a source electrode, and a drain electrode of each TFT are connected to a gate line, a data line, and a pixel electrode respectively. A liquid crystal material is provided between the pixel electrode and a common electrode (not shown). In FIG. 3, the liquid crystal material between the two electrodes is shown as a liquid crystal capacitor (Cl), and the common voltage applied on the common electrode is shown as Vcom.

The gate driver 200 applies a gate voltage to the gate line to turn the TFT on/off. The gate-on voltage is sequentially applied to the gate lines of the liquid crystal panel, and accordingly, the TFT connected to the gate line where the gate-on voltage is applied turns on. The data driver 300 applies data voltages for image signals to each data line.

The data line sharing switch 400 comprises a plurality of switching devices 410 for switching adjacent data lines according to a control signal. In the first embodiment of the present invention, the liquid crystal panel 100 and the data line sharing switch 400 are illustrated separately in the drawings for the convenience of explanation, but the data line sharing switch 400 can be placed on the liquid crystal panel 100, or it can be provided separately. When the data line sharing switch 400 is placed on the liquid crystal panel 100, the data line sharing switch 400 is preferably provided on one end of the liquid crystal panel 100.

In the embodiment of the present invention, a transistor 410 is used as switching device. It is preferable to use a thin film transistor in the case of placing the switching device 410 on the liquid crystal panel 100. In this case, an amorphous transistor or poly-crystal transistor can be used as the thin film transistor. In particular, an amorphous thin film transistor has an advantage of simplifying fabrication processes because it can be fabricated in the same process as the TFT 120 connected to the pixel electrode.

Adjacent data lines (for example, D1, D2) are connected to the source electrode and the drain electrode of each transistor 410, and a control signal (SH) is applied to the gate electrode.

A shared signal generator 500 outputs a control signal (SH) for turning on the switching device of the data line sharing switch 400, and the control signal (SH) is applied to the gate electrode of the switch 400. The sharing signal generator 500 outputs the control signal for turning on the switching device 410 right before a gate-on voltage is applied to each gate line.

Figure 4:
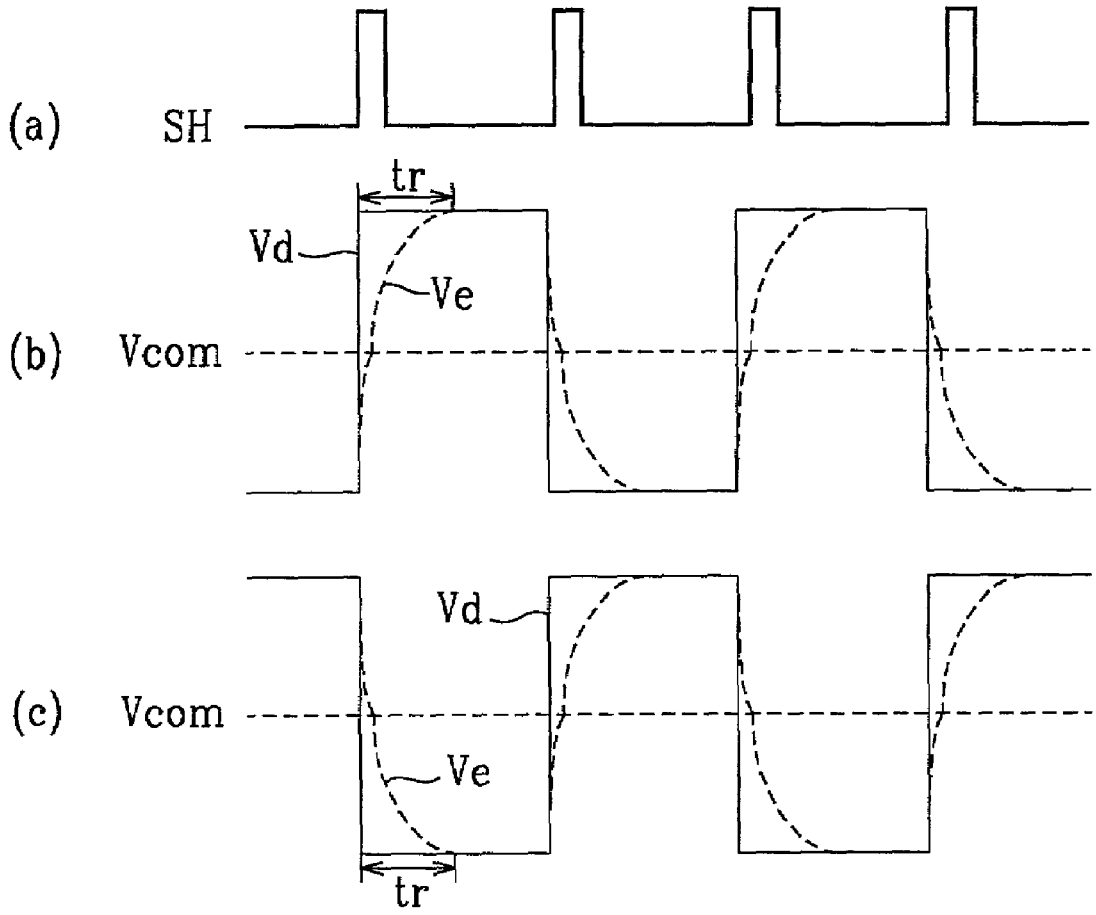
FIG. 4 shows waveforms of voltages applied to a data line according to the first embodiment of the present invention.

Now referring to FIG. 4, the driving method of the liquid crystal display according to the first embodiment of the present invention is described.

In FIG. 4, (a) shows a waveform of a sharing control signal (SH) which is output from the sharing signal generator 500, and (b) and (c) show waveforms of voltages that are applied to odd data lines and even data lines respectively. Voltage (Vd) of (b) and (c) shows the voltage applied to the data lines from the data driver 300, and voltage (Ve) of (b) and (c) shows the voltage charged to the data lines.

The first embodiment of the present invention employs a dot reverse driving method that reverses the data voltage against a common voltage (Vcom) per each pixel. Therefore, the polarity of the data voltages applied to the adjacent data lines (for example, D1, D2 . . . ) is opposite to each other. In other words, when a positive data voltage (larger than the common voltage) is applied to the odd data lines as shown in FIGS. 4 (b) and (c), a negative data voltage (smaller than the common voltage) is applied to the even data lines.

According to the first embodiment of the present invention, right before applying a gate-on voltage to each gate line, adjacent data lines are connected for a predetermined time by turning on the switching device 410 of the data line sharing switch 400. Then, the charge sharing effect between the data lines charged with data voltages of different polarities, increases or decreases the voltage of the data lines close to a common voltage (Vcom), which is in the middle of swing voltages. Therefore, the first embodiment of the present invention can sufficiently charge the data lines to a predetermined data voltage because the voltages are higher and lower around the common voltage (Vcom). As shown in FIGS. 4 (b) and (c), the data lines can be sufficiently charged with a predetermined voltage, because the time (tr) required to charge the data lines with a predetermined voltage can be reduced compared to the conventional case. Therefore, the present invention can improve voltage change characteristics in the data lines.

Figure 5:
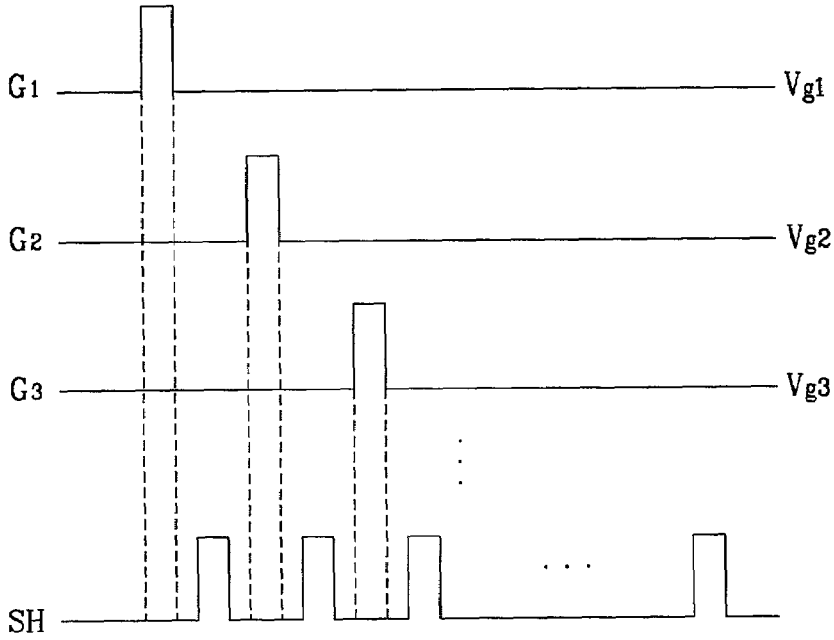
FIG. 5 is a graphical representation of a sharing control signal according to the first embodiment of the present invention.

FIG. 5 shows one example of the shared control signal (SH) used in the embodiment of the present invention.

As shown in FIG. 5, there exists a sharing signal pulse (SH) for stopping sharing of the data lines of the voltage between the gate-on voltages applied to the adjacent gate lines. In this case, after a previous gate line (for example, G1) changes to a gate-off voltage, two data lines are shared by the sharing signal pulse, and after stopping the data line sharing, the gate-on voltage is applied to a next gate line (G2).

As shown in FIG. 5, since a shared signal pulse exists between the gate-on voltage applied to two adjacent gate lines, the interval of sharing signal pulses can be reduced, if the difference between two gate-on voltages decreases. Therefore, the charge sharing between data lines may not occur sufficiently.

Figure 6:
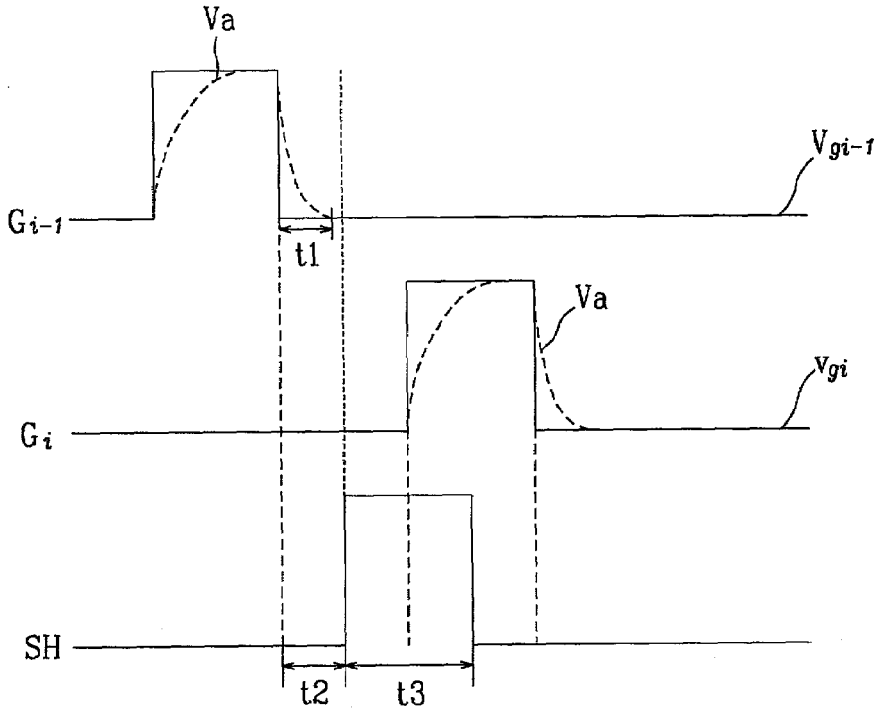
FIG. 6 is a graphical representation of a sharing control signal according to a second embodiment of the present invention.

FIG. 6 shows another example of the wave forms of a sharing control signal (SH) used in the embodiment of the present invention.

According to the sharing control signal as shown in FIG. 6, a sharing signal pulse is applied after a previous gate line ($G_{i-1}$) turns to a gate-off voltage, and the sharing signal pulse is maintained for a predetermined time after a selected gate line ($G_i$) becomes a gate-on voltage. This method achieves a sufficient interval between the sharing signal pulses, even though the interval between the two gate-on voltages decreases.

Figure 7:
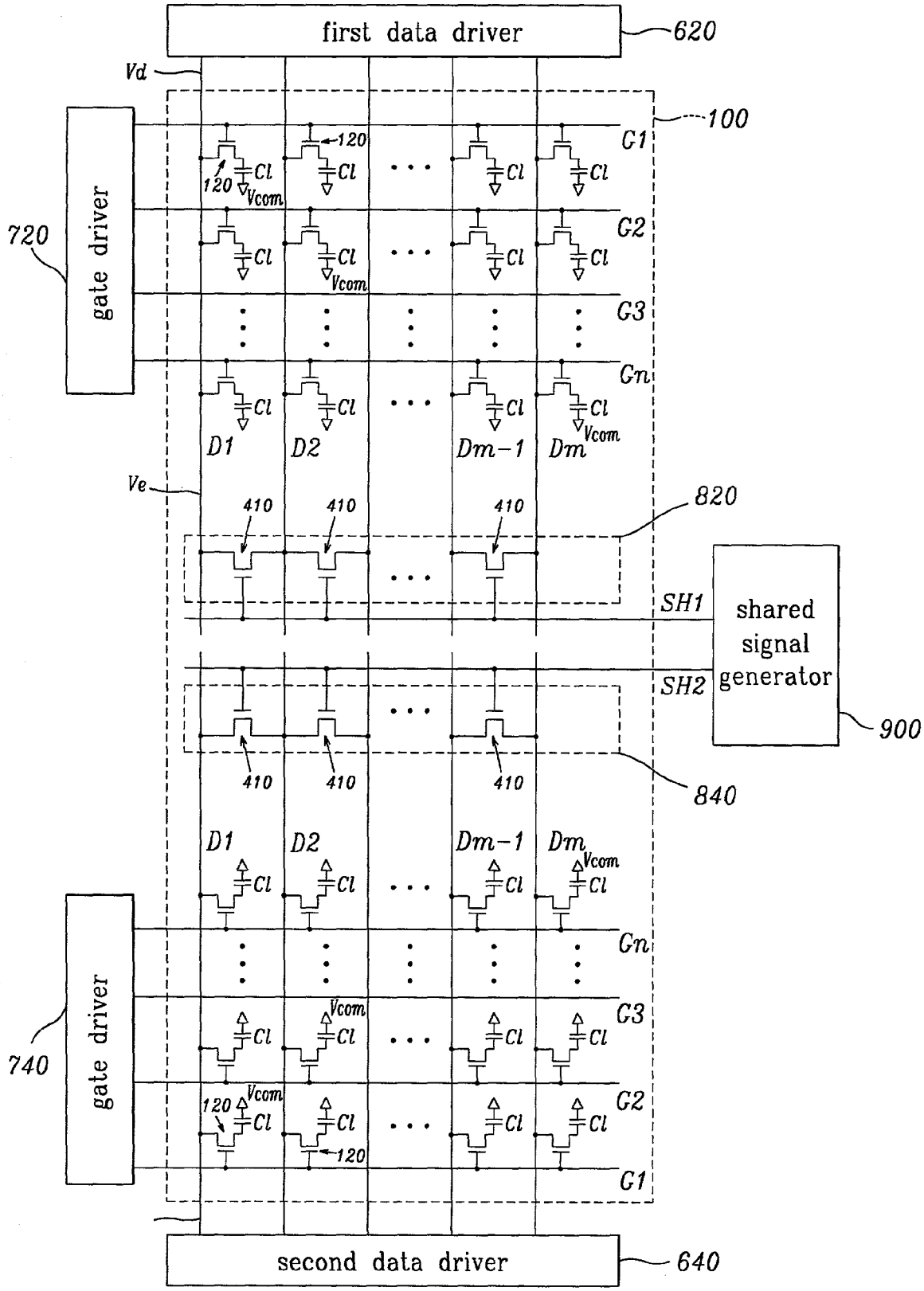
FIG. 7 is a representation showing a configuration of an LCD according to the second embodiment of the present invention.

In addition to the driving of a single driver in the above-mentioned first embodiment, a dual driver can also be used as illustrated in FIG. 7.

FIG. 7 is a schematic representation of an LCD according to a second embodiment of the present invention.

The configuration and operation of the LCD of the second embodiment of the present invention are almost similar to the first embodiment, and redundant explanations are omitted.

In the second embodiment of the present invention, data line sharing switches 820 and 840 are placed in the middle of the liquid crystal panel 100. A sharing signal generator 900 outputs a sharing control signal (SH1, SH2) for switching the switching device 410 of the sharing switches 820 and 840.

While this invention has been described in connection with what is presently considered to be the most practical and preferred embodiment, it is to be understood that the invention is not limited to the disclosed embodiments, but, on the contrary, is intended to cover various modifications and equivalent arrangements included within the spirit and scope of the appended claims.

For example, a transistor is used as a switching device in the embodiment of the present invention but other kinds of switching devices can be used as well.

As described above, according to the present invention, the data lines can be sufficiently charged with a data voltage by sharing the two adjacent data lines of different polarities right before applying a gate-on voltage and therefore, maintaining the voltage of the data lines within a predetermined value of a common voltage.

What is claimed is:

1. A method for driving a liquid crystal display comprising a plurality of gate lines, a plurality of insulated data lines crossing the gate lines, and a plurality of thin film transistors, each having a gate electrode connected to a gate line and a source electrode connected to a data line, comprising the steps of:

sequentially supplying a gate-on voltage for turning on the thin film transistor to the gate lines;

connecting the adjacent data lines and charging the data lines with a predetermined voltage; and applying the data voltage to the data lines, wherein the adjacent data lines are connected after the voltage applied to a previous gate line is changed to a gate-off voltage, and the adjacent data lines are disconnected in a predetermined time after the gate-on voltage is applied to the gate line.

2. The method of claim 1, wherein polarities of the data voltages applied to the adjacent data lines are opposite to each other.

3. The method of claim 1, wherein the predetermined voltage is close to a common voltage.

4. A liquid crystal display, comprising:

a liquid crystal panel including a plurality of gate lines, a plurality of first and second data lines, and a plurality of first and second thin film transistors each having a gate electrode connected to a gate line, a source electrode connected to a data line, and a drain electrode connected to a liquid crystal capacitor;

a gate driver for sequentially supplying a gate-on voltage to the gate lines for turning on the first and second thin film transistors;

a first data driver for applying first data voltages to the first data lines;

a second data driver for applying second data voltages to the second data lines;

a first data line sharing switch having a plurality of first commonly controlled switching devices, each of which is formed between each of the adjacent first data lines, respectively;

a second data line sharing switch having a plurality of second commonly controlled switching devices, each of which is formed between each of the adjacent second data lines, respectively; and a sharing signal generator for outputting a first sharing control signal for turning on the first switching devices to connect the adjacent first data lines and a second sharing control signal for turning on the second switching devices to connect the adjacent second data lines, wherein the first thin film transistors are disposed between the first data line sharing switch and the first data driver, and the second thin film transistors are disposed between the second data line sharing switch and the second data driver.

5. The liquid crystal display of claim 4, wherein the first and second data line sharing switches are formed on the liquid crystal panel.

6. The liquid crystal display of claim 5, wherein the first and second switching devices comprise third thin film transistors, the first switching devices having commonly connected gate terminals, and the second switching devices having commonly connected gate terminals, respectively.

7. The liquid crystal display of claim 6, wherein the third thin film transistors are incorporated in the liquid crystal panel.

8. The liquid crystal display of claim 7, wherein the first to third thin film transistors comprise amorphous transistors or polycrystal transistors.

9. The liquid crystal display of claim 4, wherein the first and second data line sharing switches are placed between the first and second data drivers.

10. A liquid crystal display as defined in claim 4 wherein the first data driver is disposed for applying first dot reverse data voltages to the first data lines, and the second data driver is disposed for applying second dot reverse data voltages to the second data lines.

11. A liquid crystal display as defined in claim 4 wherein the first commonly controlled switching devices are connected in series, and the second commonly controlled switching devices are connected in series.

12. A liquid crystal display as defined in claim 4 wherein the data lines have minimized line capacitance.

13. A liquid crystal display, comprising:

a liquid crystal panel including a plurality of gate lines, a plurality of insulated data lines crossing the gate lines, and a plurality of first thin film transistors each having a gate electrode connected to a gate line, a source electrode connected to a data line, and a drain electrode connected to a liquid crystal capacitor;

a gate driver for sequentially supplying a gate-on voltage to the gate lines for turning on the thin film transistors;

a data driver for applying a data voltage to the data lines;

a data line sharing switch having a plurality of switching devices, each of which formed between the adjacent data lines; and a sharing signal generator for outputting a sharing control signal for turning on the switching devices to connect the adjacent data lines, wherein the first thin film transistors are disposed between the data line sharing switch and the data driver, wherein the adjacent data lines are connected after the voltage applied to a previous gate line is changed to a gate-off voltage, and the adjacent data lines are disconnected in a predetermined time after the gate-on voltage is applied to the gate line.

14. A liquid crystal display, comprising:

a liquid crystal panel including a plurality of gate lines, a plurality of first and second data lines, and a plurality of thin film transistors consisting of first and second thin film transistors each having a gate electrode connected to a gate line, a source electrode connected to a data line, and a drain electrode connected to a liquid crystal capacitor;

a gate driver for sequentially supplying a gate-on voltage to the gate lines for turning on the first and second thin film transistors;

a first data driver for applying first data voltages to the first data lines;

a second data driver for applying second data voltages to the second data lines;

a first data line sharing switch having a plurality of first commonly controlled switching devices, each of which is formed between each of the adjacent first data lines, respectively;

a second data line sharing switch having a plurality of second commonly controlled switching devices, each of which is formed between each of the adjacent second data lines, respectively; and a sharing signal generator for outputting a first sharing control signal across a first sharing control signal line for turning on the first switching devices to connect the adjacent first data lines and outputting a second sharing control signal across a second sharing control signal line for turning on the second switching devices to connect the adjacent second data lines, wherein the first thin film transistors are disposed between the first data line sharing switch and the first data driver, and the second thin film transistors are disposed between the second data line sharing switch and the second data driver.

15. A liquid crystal display as defined in claim 14 wherein the first data driver is disposed for applying first dot reverse data voltages to the first data lines and the second data driver is disposed for applying second dot reverse data voltages to the second data lines.

16. A liquid crystal display as defined in claim 14 wherein the first commonly controlled switching devices are connected in series, and the second commonly controlled switching devices are connected in series.

17. A liquid crystal display as defined in claim 14 wherein the data lines have minimized line capacitance.

* * * * *